US006027396A

United States Patent [19]

Yonchar

[11] Patent Number: 6,027,396

[45] Date of Patent: Feb. 22, 2000

[54] BRASSIERES FOR REDUCING BREAST CANCER

[76] Inventor: Jack Yonchar, 722 S. Muirfield Rd., Los Angeles, Calif. 90005

[21] Appl. No.: 09/169,514

[22] Filed: Oct. 9, 1998

[51] Int. Cl.[7] ..... A41C 3/04

[52] U.S. Cl. ..... 450/36; 450/37

[58] Field of Search ..... 450/36, 1, 30, 450/53–57, 37

[56] References Cited

U.S. PATENT DOCUMENTS

| | | | |
|---|---|---|---|
| 523,888 | 7/1894 | Foy | 450/36 |
| 2,258,209 | 10/1941 | De Jorio | 450/36 |
| 2,452,345 | 10/1948 | Anselmo | 450/36 |
| 3,019,792 | 2/1962 | Kahn | 450/36 |
| 3,459,191 | 8/1969 | Barg | 450/36 |
| 4,222,388 | 9/1980 | Brown . | |
| 4,270,538 | 6/1981 | Murphy . | |
| 5,032,103 | 7/1991 | Larsson . | |
| 5,050,595 | 9/1991 | Krafft . | |
| 5,301,681 | 4/1994 | DeBan et al. . | |
| 5,679,052 | 10/1997 | Rucki . | |
| 5,743,272 | 4/1998 | Kocher, Jr. . | |

*Primary Examiner*—Gloria Hale
*Attorney, Agent, or Firm*—Eric K. Satermo

[57] ABSTRACT

A brassier for reducing breast cancer includes cups for holding the mammary glands. Each of the cups has a slot formed therein for accommodating a papilla. Each slot is longitudinally elongated to accommodate for variances in the longitudinal location of the papilla from woman to woman. By positioning the papilla within the slots, the papillae are not subject to pressure and compression which inflict trauma on the breasts. The brassier for reducing trauma may include cup linings disposed within the cups. Each lining has an opening formed therein for accommodating a papilla. Each lining may also have protective material disposed about the opening to provide protection for the papilla when received within the opening.

10 Claims, 3 Drawing Sheets

BRASSIERES FOR REDUCING BREAST CANCER

FIELD OF THE INVENTION

The present invention relates to feminine garments and, more particularly, to brassieres with medical applications.

BACKGROUND OF THE INVENTION

With reference to FIG. 1, the mammary glands of a woman secrete milk and are accessory glands of the generative system. The glands are two hemispherical eminences lying within the superficial fascia and situated on the front and sides of the chest. Each gland extends from the second rib above to the sixth rib below, and from the side of the sternum to near the mid-axillary line. The weight and dimensions of the mammary glands differ at different periods of life and in different individuals. Before puberty the mammary glands are small in size, but enlarge as the generative organs become more completely developed. The glands increase during pregnancy and especially after delivery, and become atrophied in old age. The left gland is generally a little larger than the right. The deep or inner surface of each is nearly circular, flattened, or slightly concave, and has its long diameter directed upward and lateralward toward the axilla (which is the pyramidal space situated between the upper lateral part of the chest and the medial side of the arm). Each gland is separated from the fascia covering the Pectoralis major, Serratus anterior, and Obliquus externus abdominis by loose connective tissue. The subcutaneous surface of the mammary gland is convex and presents, just below the center, a small conical prominence, or papilla 10.

The mammary papilla or nipple 10 is a cylindrical or conical eminence situated about the level of the fourth intercostal space. It is capable of undergoing erection from mechanical stimulation, a change mainly due to the contraction of its muscular fibers. Its surface is wrinkled and provided with secondary papillae, and it is perforated by from 15 to 20 orifices, the apertures of lactiferous ducts 12. The base of the mammary papilla 10 is surrounded by an areola 14. Near the base of the papilla 10, and upon the surface of the areola 14, are numerous large sebaceous glands, the areolar glands, which become much enlarged during lactation, and present the appearance of small tubercles beneath the skin. The mammary papilla 10 consists of numerous vessels, intermixed with plain muscular fibers, which are principally arranged in a circular manner around the base.

The mammary gland consists of gland tissue; of fibrous tissue, connecting its lobes; and of fatty tissue in the intervals between the lobes. The subcutaneous surface of the mammary gland presents numerous irregular processes which project toward the skin and are joined to it by bands of connective tissue. It consists of numerous lobes, which are composed of lobules 16, connected together by areolar tissue, blood vessels, and ducts. The smallest lobules consist of a cluster of rounded alveoli, which open into the smallest branches of the lactiferous ducts 12. These ducts unite to form larger ducts, and these end in a single canal, corresponding with one of the chief subdivisions of the gland. The number of excretory ducts varies from 15 to 20, which are termed the tubuli lactiferi. They converge toward the areola 14, beneath which they form dilatations or ampullae 18, which serve as reservoirs for the milk, and, at the base of the papillae 10, become contracted and pursue a straight course to its summit, perforating it by separate orifices considerable narrower than the ducts themselves.

The fibrous tissue of the mammary glands invests the entire surface of the mamma. Bands of fibrous tissue traverse the gland and connect the overlying skin to the underlying pectoral fascia. These constitute the ligaments of Cooper. The fatty tissue 20 covers the surface of the gland, and occupies the interval between its lobes. It usually exists in considerable abundance, and determines the form and size of the gland. However, there is no fat immediately beneath the areola 14 and papilla 10.

Trauma is inflicted by conventional brassieres by constriction and pressure applied to the papillae and the lactiferous tubules, ampullae, and lobules. Aggravation to the breast is furthered by friction of conventional brassieres on the papillae and areolae during activities such as walking and exercising, and while lying on the breast while sleeping.

Conventional brassieres encase the entire breast and compress and constrain the papillae and areolar area where the lactiferous tubules are located. The compression of the papillae and the tubules are irritating factors that inflict trauma on the breasts and may contribute to the formation of cancer.

In view of the foregoing, there is a need in the art for a brassier which reduces trauma to the breasts, particularly trauma to the papillae and areolae.

BRIEF SUMMARY OF THE INVENTION

The present invention provides brassier which reduce the trauma subjected to breasts, particularly trauma to the papillae and areolae. Such trauma reduction may contribute to the reduction of breast cancer caused by irritation and compression of conventional brassieres on the breasts.

In accordance with one aspect of the present invention, a brassier includes cups for holding mammary glands. Each of the cups has a slot formed therein for accommodating a papilla. Each slot is longitudinally elongated. Because of the elongated configuration, the slots are able to accommodate for variances in the longitudinal location of the papilla from woman to woman. By positioning the papilla within the slots, the papillae are not subject to pressure and compression which inflict trauma on the breasts.

According to another aspect of the invention, the brassier of the present invention may include cup linings respectively disposed within the cups. Each lining has an opening formed therein for accommodating a papilla. Each lining may also have protective material disposed about the opening to provide protection for the papilla when received within the opening. The protective material may be resilient or compressive material such as foam rubber. The protective material further reduces trauma which may be inflicted by tight-fitting garments or during sporting activities. In addition, the linings are preferably made from resilient material, which further enhances the shock-reducing functionality of the brassier to reduce trauma.

Other objects, features, and advantages of the present invention will become apparent to those skilled in the art from a consideration of the following detailed description taken in conjunction with the accompanying.

DETAILED DESCRIPTION OF THE INVENTION

Figure 1:
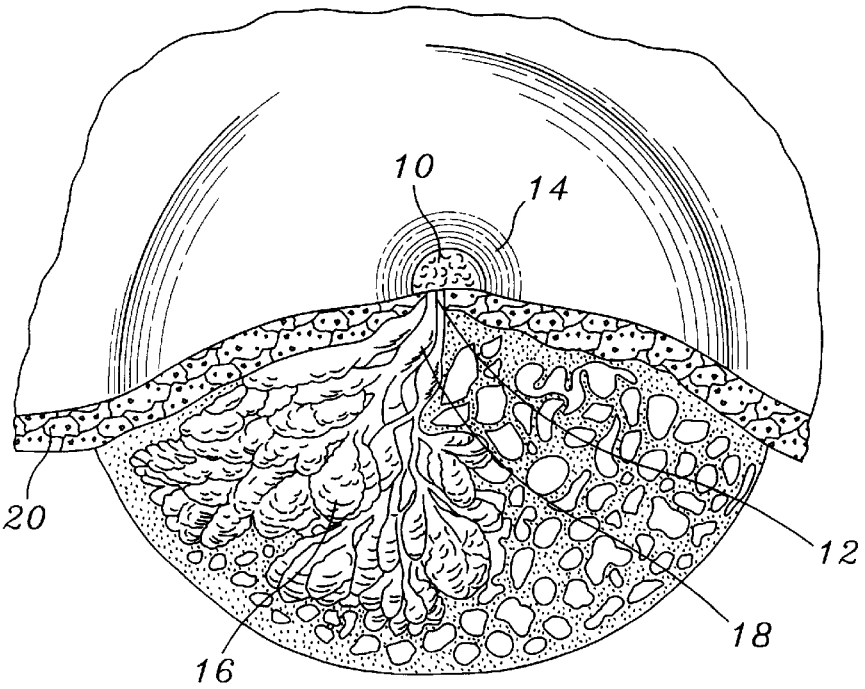
FIG. 1 is a perspective view of a mammary gland shown in partial section.
Figure 2:
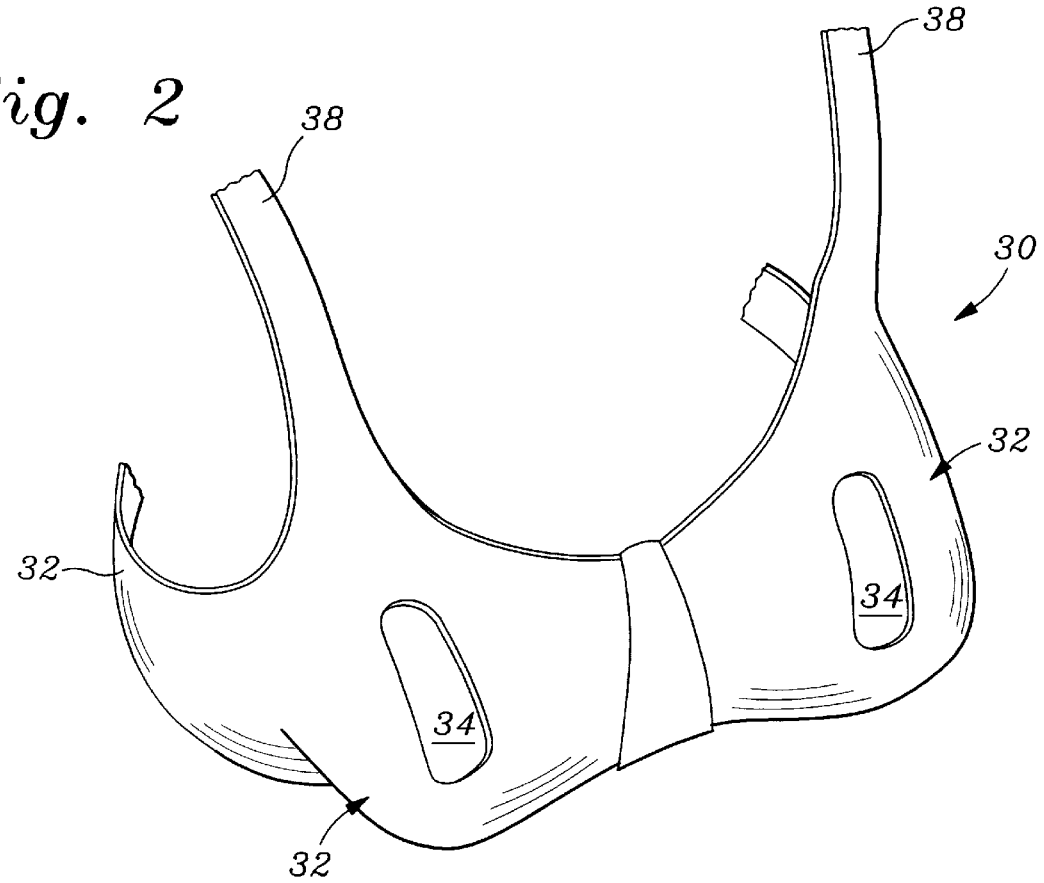
FIG. 2 is a perspective view of an exemplary embodiment of a brassier for reducing breast cancer in accordance with the present invention.

Referring more particularly to the drawings, an exemplary brassier 30 for reducing breast trauma and cancer produced in accordance with the teachings of the present invention is illustrated in FIG. 2. The brassier 30 generally includes cups 32 for holding mammary glands. Each of the cups 32 has a slot 34 formed therein for accommodating a papilla. Each slot 34 is generally elongated and extends longitudinally across the cup 32. As shown in FIG. 2, exemplary brassier 30 may also include a chest strap 36 and shoulder straps 38, as known in the art.

Because of the elongated configuration, the slots 34 are able to accommodate for variances in the longitudinal location of the papilla from woman to woman. The slots 34 may also be sufficiently wide to accommodate for variances in the lateral location of the papilla from woman to woman. However, the lateral position is predominantly dictated by the cups 32 in aligning the papillae respectively within the slots 34. By positioning the papilla within the slots 34, the papillae are not subject to pressure and compression. Accordingly, a more natural situation is effected.

Figure 5:
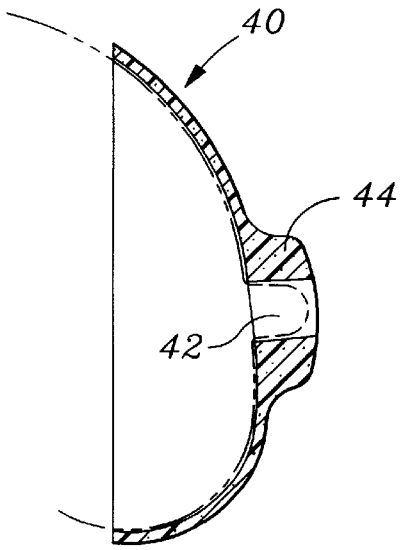
FIG. 5 is a cross-sectional view of the cup lining taken along line 5—5 of FIG. 4.
Figure 4:
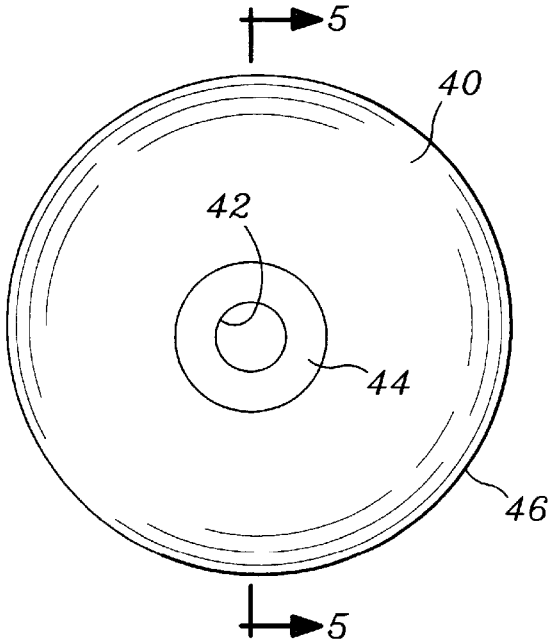
FIG. 4 is a plan view of a cup lining of the present invention.
Figure 3:
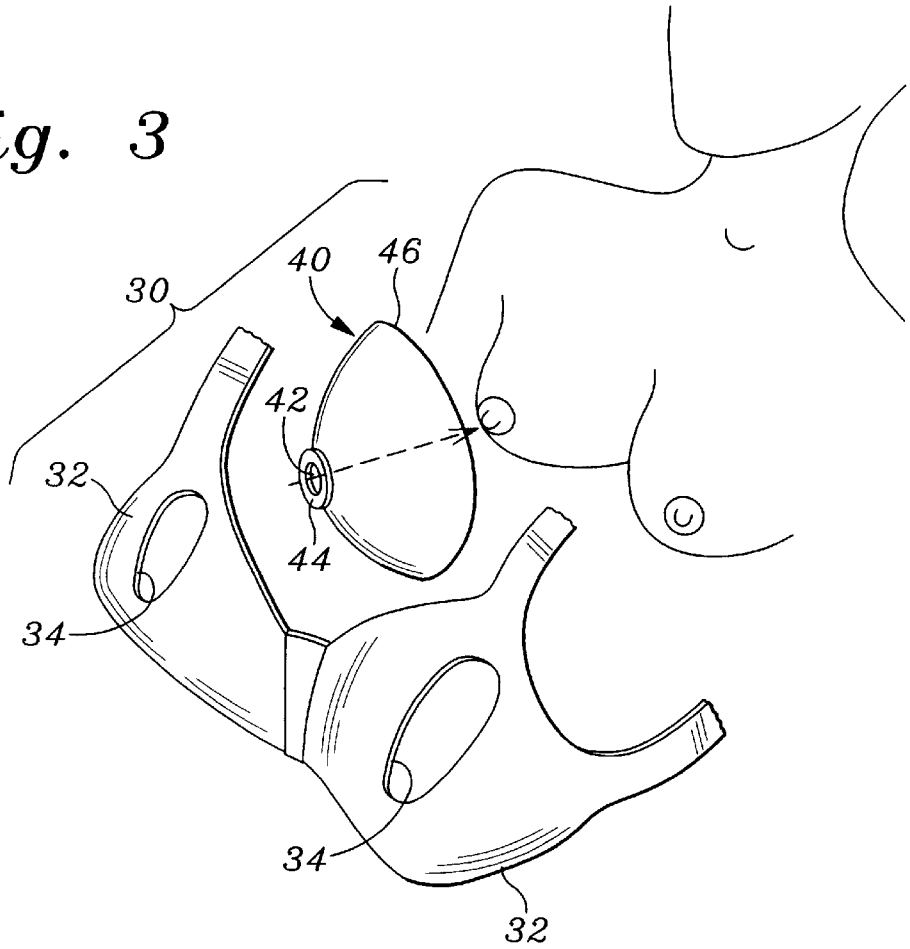
FIG. 3 is a perspective view of another exemplary embodiment of a brassier for reducing breast cancer in accordance with the present invention.

Referencing FIGS. 3, 4, and 5, exemplary brassier 30 may also include cup linings 40 respectively disposed within the cups 32. (For clarity, only one lining 40 is shown in FIG. 3, and the lining 40 is shown separated from the cup 32.) Each lining 40 has an opening 42 formed therein for accommodating a papilla. Each lining 40 may also have protective material 44 disposed about the opening 42. The protective material 44 provides protection for, and, thereby, further reduces trauma to, the papilla when received within the opening 42. The protective material 44 may be resilient or compressive material such as foam rubber.

Each lining 40 is preferably attached to a respective cup 32 along a periphery 46 thereof by stitching. Accordingly, the lining 40, as well as the protective material 44, is independently movable with respect to the cup 32. This feature of the brassier 30 provides enhanced shock-reducing functionality, thereby further reducing trauma. In addition, the linings 40 are preferably made from resilient or stretchable material such as lycra, further enhancing the shock-absorbing feature of the brassier 30. Alternatively, each lining 40 may be a separate or detached element of the brassier 30, or may be attached only along a portion of the periphery 46. Releasable fasteners such as hook-and-eye fasteners may also be used to attach the linings 40 to the cups 32.

The opening 42 may be formed completely through the lining 40 or may be formed as a recess with the lining 40 extending over an outer side thereof, as shown in FIG. 5. With the lining 40 covering the outer side of the opening 42, any irritation to the papillae caused by a garment is eliminated. In addition to the substantially circular configuration shown in the drawings, the openings 42 may be elongated or oval. As particularly shown in FIG. 4, the lining 40 is preferably cup shaped to complement the shape of the cup 32 and to substantially cover a mammary gland.

Figure 6:
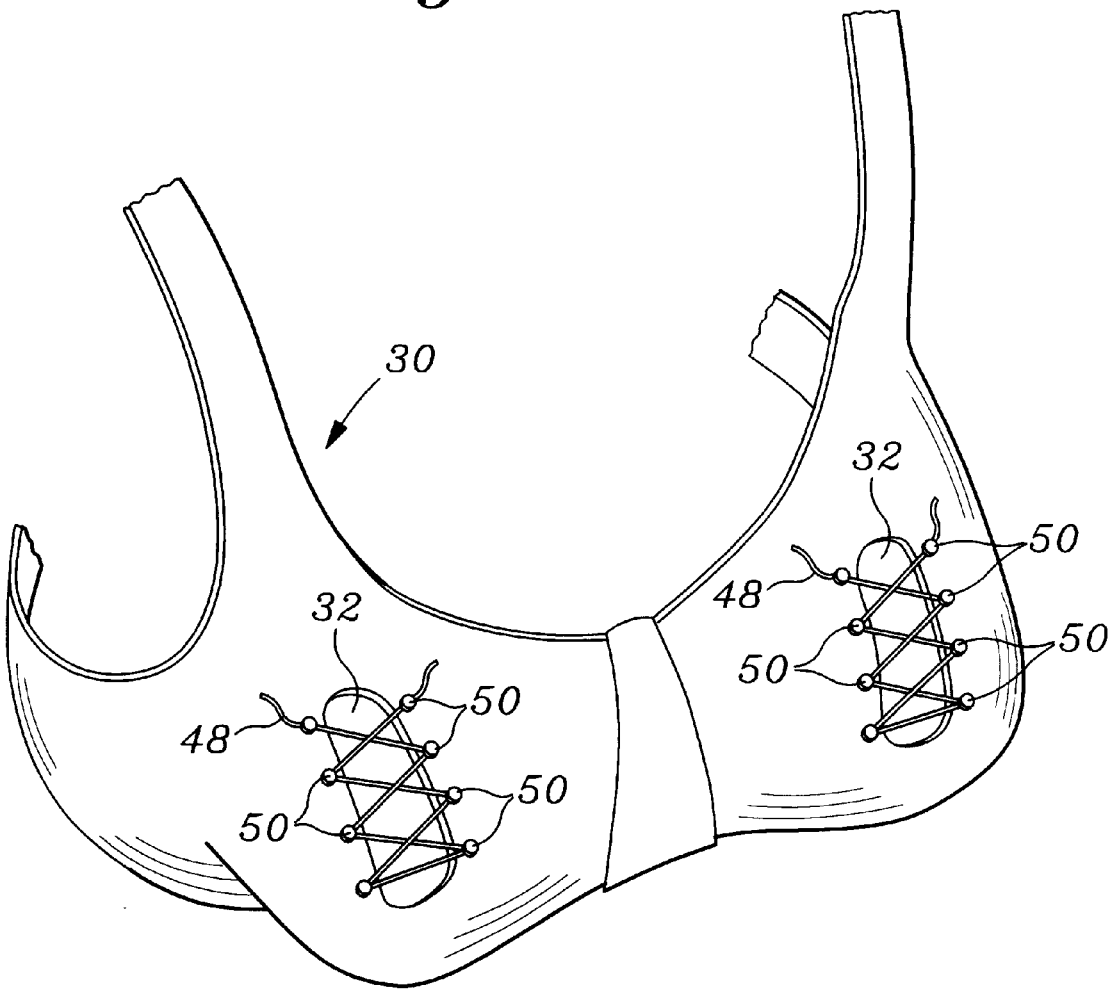
FIG. 6 is a perspective view of another exemplary embodiment of a brassier for reducing breast cancer in accordance with the present invention.

Referencing FIG. 6, exemplary brassier 30 may also include lacing 48 received in a plurality of grommets 50 formed around each slot 32. Accordingly, the width of each slot 32 may be adjusted by the user according to a preferred level of support.

In a commercial embodiment of the invention, the cups 32 may be sized as known in the art. The slots 34 may range in lateral width upwards from about ⅜ inch, and may range in longitudinal length from about ⅝ inch to, for example, about 5 inches, for the average-figure woman.

Those skilled in the art will understand that the present invention is not limited to the specifically illustrated and described embodiments above. The scope of the present invention is determined by the terms of the appended claims and their legal equivalents, rather than by the examples described above.

What is claimed is:

1. A brassier for reducing breast cancer, comprising:

a cup for holding a mammary gland; and a slot formed in said cup for accommodating a papilla;

said slot being elongated longitudinally;

whereby said slot accommodates for variances in areolar location in a longitudinal direction.

2. A brassier for reducing breast cancer, comprising:

a cup for holding a mammary gland;

a slot formed in said cup for accommodating a papilla; and a lining received in said cup and including an opening for accommodating a papilla;

said slot being elongated longitudinally;

whereby said slot accommodates for variances in areolar location in a longitudinal position.

3. A brassier as claimed in claim 2 wherein said lining further comprises protective material disposed about said opening.

4. A brassier as claimed in claim 3 wherein said protective material is substantially resilient.

5. A brassier as claimed in claim 3 wherein said protective material is foam rubber.

6. A brassier as claimed in claim 2 wherein said opening is substantially circular.

7. A brassier as claimed in claim 2 wherein said lining is configured to be disposed substantially over a mammary gland.

8. A brassier as claimed in claim 2 wherein said lining is attached to said cup along a periphery of said lining.

9. A brassier as claimed in claim 2 wherein said lining is made from spandex.

10. A brassier for reducing breast cancer, comprising:

a cup for holding a mammary gland;

a slot formed in said cup for accommodating a papilla; and a plurality of grommets formed along sides of said slot and a lace received in said grommets;

said slot being elongated longitudinally;

whereby said slot accommodates for variances in areolar location in a longitudinal direction and said slot is adjustable in width.

* * * * *